US005121418A

United States Patent [19]

Staheli et al.

[11] Patent Number: 5,121,418

[45] Date of Patent: Jun. 9, 1992

[54] DISTANCE OF TRAVEL MEASURING DEVICE FOR USE WITH A BALE OPENING MACHINE

[75] Inventors: Christoph Staheli, Frauenfeld; Martin Kyburz, Andelfingen; Peter Anderegg, Winterthur, all of Switzerland

[73] Assignee: Maschinenfabrik Rieter AG, Winterthur, Switzerland

[21] Appl. No.: 745,837

[22] Filed: Aug. 16, 1991

Related U.S. Application Data

[62] Division of Ser. No. 565,513, Aug. 10, 1990.

[30] Foreign Application Priority Data

Aug. 10, 1989 [CH] Switzerland ..... 3926482
Dec. 29, 1989 [CH] Switzerland ..... 3943322

[51] Int. Cl.[5] ..... G01C 22/00
[52] U.S. Cl. ..... 377/24.1; 364/561
[58] Field of Search ..... 377/24.1; 364/561; 100/100

[56] References Cited

U.S. PATENT DOCUMENTS 3,792,533 2/1974 Plasser et al. ..... 377/24.1
3,809,864 5/1974 Sampey ..... 377/24.1
3,955,073 5/1976 Carew et al. ..... 364/561
4,256,278 3/1981 Sanville ..... 377/24.1
4,922,447 5/1990 Reichel ..... 364/561
5,051,935 9/1991 Matty ..... 364/561

FOREIGN PATENT DOCUMENTS 3335792 4/1985 Fed. Rep. of Germany .

*Primary Examiner*—John S. Heyman
*Assistant Examiner*—Scott A. Ouellette
*Attorney, Agent, or Firm*—Sandler, Greenblum & Bernstein

[57] ABSTRACT

A method and an apparatus for operating a bale opening machine having an opening member, wherein the height profile of a row of bales is determined by at least one sensor directed towards the bale surface and is used to control the position of the opening member during the subsequent bale opening. The received signal of the sensor, which is preferably an optical or acoustical sensor or a sensor which operates with radar waves, is processed to obtain a signal corresponding to the hardness of the bales. In addition, the in-feed and, optionally, the penetration of the opening member, is controlled or regulated in accordance with the hardness signal. Various slip-free length measuring devices serve to determine the longitudinal position of the opening member along the row of bales.

14 Claims, 9 Drawing Sheets

POSITION ALONG THE BALE ROW
OUTPUT OF DISTANCE MEASURING SENSOR CORRECTED FOR HEIGHT H
0
53
43
44
45
46
47
57
59
49.1
54
45.1
50.1
48
51.1
46.1
58
52.1

POSITION ALONG THE BALE ROW
MEAN DISTANCE OF BALE SURFACE FROM FLOOR
53
57
59

POSITION ALONG THE BALE ROW
HARDNESS OF BALE SURFACE
53.3
43.3
44.3
45.3
57.3
46.3
47.3
59.3

DISTANCE OF TRAVEL MEASURING DEVICE FOR USE WITH A BALE OPENING MACHINE

This application is a division of application Ser. No. 07/565,513, filed Aug. 10, 1990, pending.

BACKGROUND OF THE INVENTION

1. Field of the Invention

The present invention is related to a method of operating a bale opening machine having an opening member wherein the height of a row of bales is determined by means of at least one sensor directed towards the bale surface and is used to control the position of the opening member during the subsequent bale opening, and also to an apparatus for carrying out this method.

2. Description of Background and Other Information

A method and apparatus of the aforementioned type is described in DE PS 31 53 246. In the known apparatus, three sensors in the form of optical proximity switches are mounted on the arm which carries the opening member. This arm is manually moved over the first bales of the row of bales. After actuating a start button, the arm sinks downwardly. As soon as the first sensor transmits the signal, the instantaneous count is stored in a memory. The same takes place for each further sensor. When the last sensor has also transmitted its signal, the downward movement is stopped, the tower with the arm continues to move at a slow speed along the row of bales, and the arm is moved upwardly to the level at which the first sensor responded, plus a certain amount. Once it has reached this height, the arm again sinks downwardly and the height determination takes place again as described above.

In the described manner, a plurality of measured values is obtained from which an average value is formed which is used for the further working-off process. Because the arm of the opening member moves continuously upwardly and downwardly when carrying out the measurements, a relatively large amount of time is lost for the one time derivation of the height profile of the row of bales. Furthermore, the aforementioned document does not describe how the actual opening process is carried out, starting from the average value, with this opening process naturally taking place during a later movement of the arm along the row of bales. A predetermined in-feed amount, or advance, is presumably preset starting from the average value, i.e., the arm with the opening member is caused to sink beneath the average value by a predetermined amount and the opening takes place with this fixed preset in-feed. The object of this first opening pass is to bring the row of bales to a uniform level so that, in subsequent opening passes, one can always operate with fixed preset in-feed depths. This known method does not take account of the differing hardnesses of the different bales or of the different components of the row of bales.

The present Applicant's European Application No. 85 115 579 (Publication No. 193 647) describes a method of removing fiber flocks from textile fiber bales in which the in-feed for each opening movement along the row of bales is selected in accordance with the bale hardness in different regions of the bales. This embodiment takes account of the fact that the bales have a varying density, i.e., hardness, and indeed such that the hardness is lower in the upper and lower regions of the bales than it is in the middle regions, so that the in-feed depth in the upper and lower regions may be larger than in the middle region.

This document does not, however, describe the determination of the hardness of the bales. This is, however, of great importance in practice, at least if it is desired to operate a bale opening machine at the upper limits of performance, in order to economically obtain maximum production. Although one can operate with values for the hardness of the individual bales which are determined with experience, in many cases this is not very accurate. For example, when putting together a row of bales of different origins (called components) the material is frequently manually lifted from the higher bales of one component and placed on the lower bales of the same component. In this way the assumed hardness distribution of the individual bales is falsified. Furthermore, since bales of different origins originate by definition from different regions, they are thus pressed together using different plants and have different fiber characteristics, so that the hardness distribution in the bales of different origins is also different.

SUMMARY OF THE INVENTION

The object of the present invention is to so improve the method and/or apparatus of the aforementioned type that one can on the whole operate more economically and indeed take account of the hardness of the individual bales or components of the bale row, with the hardness preferably being determined at the same time that the height profile is determined.

To this end, the method of operating a bale opening machine according to the invention includes determining a height profile of a row of bales including directing at least one distance measuring sensor towards the bales during the passing of the opening member along the row of bales and controlling the position of the opening member during subsequent bale opening as a function of the height profile.

More specifically, the height profile is determined by directing at least one sensor towards respective bale surfaces of bales in the row of bales; obtaining a sensor signal from the sensor for subsequent control of the position of the opening member during a subsequent bale opening procedure; processing the sensor signal to produce at least a bale hardness signal; and controlling the in-feed of the opening member with respect to the bales as a function of the hardness signal.

The sensor, according to the invention, can be embodied as an optical sensor, an acoustical sensor, or a radar wave sensor, for example.

According to a certain aspect of the invention, the in-feed of the opening member is controlled with respect to the bales as a function of the hardness signal including regulating the in-feed of the opening member with respect to the bales as a function of the hardness signal.

Further, the penetration of the opening member with respect to the bales is controlled as a function of the hardness signal.

According to a further specific feature of the invention, the amplitude fluctuations of the sensor signal are processed to produce a bale hardness signal. Specifically, the deviations of the sensor which have a positive sign with respect to the mean value of the sensor signal, are summed.

Further according to the invention, the sensor signal has a basic frequency, and the amplitude fluctuations of the sensor signal that are sensed and processed are scanned at a frequency which is at least twice the basic frequency of the sensor signal.

According to a still further aspect of the invention, the method of the invention further includes periodically starting the sensor; directly transferring instantaneous measured values of the sensor signal to a computer in digital form; and storing the instantaneous measured values in the computer in an array.

According to a more detailed aspect of the present invention, a first row of bales is positioned on one side of the bale opening member and a second row of bales is positioned on another side of the bale opening member, and a height profile of the first row of bales can be determined while opening the second row of bales.

Further according to the invention, an in-feed profile is determined for the row of bales as a function of the height profile and the hardness profile for maintaining optimized production of the bale opening machine during opening of bales having different origins.

Multiple passes of the bale opening machine are made along the row of bales and, during the multiple passes, the bales are opened as a function of the height profile and the hardness profile to minimize bale remainders.

Optimally, according to the invention, a central computer is programmed to control the opening of the bales along the row of bales to progressively achieve a horizontal line along the upper surfaces of the bales along the row.

During a first pass of the bale opening machine along the row of bales, the height profile of the row of bales is determined. Although the height profile can be determined during an idling run of the opening member, according to the invention, simultaneously with the determination of the height profile, the row of bales are also opened during the first pass. During this first pass, the opening member is moved at a generally constant height.

Alternatively, during the first pass of the bale opening machine, the opening member is moved in a predetermined step-wise manner as a function of the height profile.

Further, according to the invention, during additional passes of the bale opening machine, the opening member is manipulated to obtain an approximately maximum opening amount to obtain a minimum height profile during a final pass of the bale opening machine.

According to an additional feature of the invention, a preset desired fiber flock opening value for the opening machine is determined. Thereafter, an actual opening value is determined as a function of the in-feed depth of the opening member and the hardness signal, and the in-feed depth of the opening member is regulated to achieve the preset desired fiber flock opening value or approximately the preset desired fiber flock opening value.

Further, the distance measuring sensor of the invention can determine the beginning and/or ending of the row of bales, and the presence and length of any gaps between bales within the row.

The sensor signal obtained is proportional to the path of travel of the opening member, whereby a hardness profile and an in-feed depth profile can be determined as a function of the path of travel.

In a more specific aspect of the invention, a maximum opening depth of the opening member is set whereby, during the first pass, the opening member is guided to follow the upper bale surfaces of the bales in a step-wise manner while determining the height profile. The opening member is guided at a constant height during the second pass and the third pass to not exceed the maximum opening depth and, during no later than the fourth pass, the upper surfaces of the bales are substantially levelled with respect to each other.

A still further object of the invention includes a bale opening apparatus including:

- an opening member for opening at least one row of bales;
- means for supporting the opening member in a longitudinal direction along the row of bales for opening the bales;
- means for supporting the opening member for vertical movement for establishing a height of the opening member with respect to a support surface;
- means for determining a height profile of the row of bales including at least one distance measuring sensor; and
- means for controlling the height of the opening member, as the opening member moves along the row of bales, in response to the height profile determined by the determining means.

More specifically according to the invention, the means for supporting the opening member for vertical movement includes an arm to which the opening member is supported, the arm having a front portion, with respect to the longitudinal direction for opening the bales, the distance measuring sensor being positioned on the front portion of the arm.

According to a particular embodiment of the invention, a plurality of distance measuring sensors, for parallel operation, are mounted on the front portion of the arm.

Further, a further distance measuring sensor is positioned on the rear portion of the arm.

In a still further, more specific embodiment of the invention, the means for supporting the opening member in a longitudinal direction along the row of bales for opening the bales further includes a longitudinally movable and rotatable tower adapted to open rows of bales positioned on either longitudinal side of the tower, the opening member being mounted on one side of the tower and the distance measuring sensor being located on the tower laterally opposite the opening member.

A further object of the invention includes a distance measuring sensor is provided for determining the longitudinal position of the opening member. Movement of the opening member is controlled in response to signals received from the distance measuring sensor for determining a longitudinal position of the opening member.

The distance of travel measuring device of the invention, for use with the bale opening apparatus, includes:

- an elongated part adapted to extend along the bale row;
- means for sensing the elongated part in a slipfree manner during movement of the bale opening machine along the bale row;
- means for transmitting a pulse signal at the occurrence of a predetermined increment of movement of the tower along the bale row; and
- means for counting the pulse signals and generating a signal representative of distance travelled by the tower along the bale row.

According to a further aspect of the invention, the elongated part can be secured to the fiber flock transport channel.

Further according to the invention, the elongated part is a rail, the means for sensing is a wheel mounted on the tower for slip-free rolling along the rail, and the means for transmitting a pulse signal is operatively connected with the wheel for transmitting the pulse signal.

In one embodiment, the rail is a rack and the wheel is a gearwheel which meshes with the rack.

Alternatively, the elongated part is a chain fixedly mounted relative to the tower, chain deflecting devices are located at opposite ends of the bale row for guiding endless movement of the chain as the tower moves along the bale row, the means for sensing is a chain sprocket driven by the chain, and the means for transmitting a pulse signal is operatively connected with the chain sprocket for transmitting the pulse signal. The chain sprocket can form one of the chain deflecting devices.

Still further according to the invention, the elongated part has a repeating pattern of discontinuities, the means for sensing being capable of sensing the discontinuities.

In a particular embodiment, the elongated part is a rail and the repeating pattern of discontinuities is formed by apertures in the rail.

Alternatively, the repeating pattern of discontinuities is formed by teeth and gaps between the teeth.

According to a further alternate embodiment, the elongated part being a fixedly tensioned chain and the repeating pattern of discontinuities are formed by links in the chain.

The means for sensing in the distance of travel measuring device can be a light sensor or an inductive sensor.

According to a further aspect of the invention, the discontinuities are spaced apart by more than approximately ten centimeters, and the distance of travel measuring device further includes an interpolating means for measuring the distance travelled by the tower.

Means for monitoring time intervals between the pulse signals is also provided. Preferably, the counting means, interpolating means, and the monitoring means are integrated in a microprocessor.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
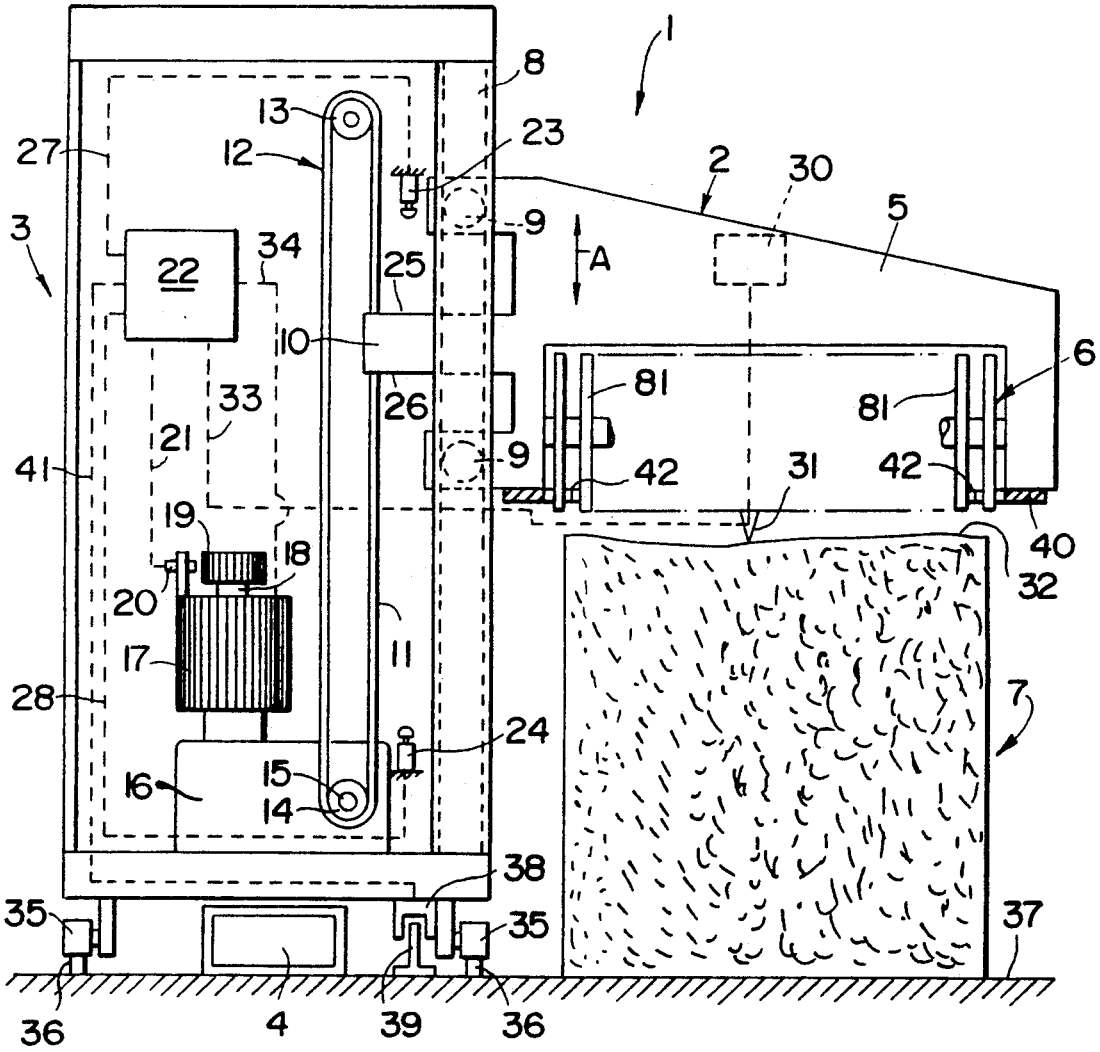
FIG. 1 is an end elevation view of a bale opening machine at the start of a row of bales.

In order to satisfy the object of economically operating the opening apparatus and taking account of the hardness of the individual bales or components of the bale row, the received signal of the sensor, which is preferably an optical or acoustical sensor or a sensor which operates with radar waves, is processed to obtain a signal corresponding to the hardness of the bales, and in that the in-feed, or advance, and optionally, also, the penetration of the opening member is controlled or regulated in accordance with the hardness signal.

Instead of using a proximity sensor, the invention thus operates with a distance measuring sensor which is likewise mounted on the arm, or on the tower which carries the arm, and which is moved at a uniform height over the row of bales during the scanning of the height. The signals which arise in this way are then also evaluated in accordance with the invention to determine the bale hardness in the surface region which is disposed directly beneath the measurement sensor. The in-feed can then also be accurately determined using this relatively precise information and with regard to the desire to attain the highest possible production or to maintain the highest possible production. Not only the in-feed, i.e., the amount by which the entire opening member is moved downwardly for the next working pass along the row of bales, but also the penetration depth of the opening member, i.e., the amount by which the working elements, for example, the teeth of the opening member, project through the associated grid, depend upon the hardness of the particular bale being opened, so that the present invention makes it possible in each case to ideally adapt both the in-feed and also the penetration depth to the prevailing bale hardness.

Various possibilities exist for the processing of the sensor signal into a hardness signal. When the hardness of the surface regions of the bales is high, the recaptured sound energy density is larger than is the case with a softer bale surface. The hardness of the surface region can thus be determined from the amplitude of the received signal, with it being necessary to take account of the reduction of the amplitude with increasing distance between the measurement sensor and the bale surface.

In accordance with the invention, the hardness signal is, however, preferably determined from the fluctuations, in particular from the amplitude fluctuations of the sensor signals. This can, for example, take place in that the hardness signal is determined by summing the deviations of the sensor signal having a positive sign from the average value of this signal. Generally usable mathematical algorithms are also known which make it possible to obtain the mean amplitude fluctuations of the sensor signals from these signals, with the sensor signal being scanned (sampled) with a frequency higher than the basic frequency of the signal, i.e., the basic frequency of the fluctuating sensor signals. The bale surface is scanned at various sequential points, at least when using a distance measuring sensor which operates on an ultrasonic basis. This is necessary because the time separation between individual measurements must be selected to be sufficiently long to take account of the transit time of the ultrasonic signal and the transit time of the electronic signals. A certain safety spacing should also be present between sequential measurements so that the ultrasonic oscillations of one measurement can die away before the next measurement is effected.

If one considers the cotton surface as being sinusoidal in form, by way of a model, then, in order to reconstruct the surface, a measured value must be recorded more frequently than once per centimeter (cm). In practice, however, it is sufficient to obtain information on the nature of the surface from a few measurements (for reasons of statistical distribution and the measurement process which is used).

The hardness can be separately derived for each bale or for each component of the row of bales. Thus, during the subsequent working-off of the bales, one can select a different in-feed depth or penetration depth for each bale or for each component. The laying of parts of one bale onto other bales does not particularly disturb the working process in this case since the actually prevailing hardness of the bale surface is always measured. In further contrast to the method of DE PS 31 53 246, mentioned above, both the height profile and also the hardness profile can thus be determined in accordance with the invention for each opening pass. The possibility also basically exists of determining the height profile of the row of bales during an idling run of the opening member above the row of bales. This process is less complicated than in the prior art because continuous up and down movements of the arm are not necessary, so that a saving of control complexity and time can be achieved.

In bale opening machines in which the bale rows are arranged on both sides of the bale opening machine, the possibility also exists of determining the height profile and the hardness profile of the one bale row during the opening of the other bale row.

In this method the height profile which is scanned during a first pass of the opening member along a row of bales is read into a computer which, on the basis of this height profile and of the computed hardness profile, computes an in-feed profile which varies over the length of the row of bales at which the production can be kept approximately at a maximum, taking account of the desired mixing ratio of the individual bales of different origins.

The computer is preferably so programmed that it endeavors during several opening passes to so open all the bales in accordance with the respectively measured hardnesses and the desired mixing ratio that, at the end of the opening process the whole row has been opened without leaving notable bale reminders. A method of this kind simplifies the subsequent erection of a new bale row and simplifies the subsequent opening of the new bale row, since unnecessary height and hardness restrictions for the new bale row can be thereby avoided.

The computer operates in such a way that it always aims at an in-feed depth or an in-feed depth profile for each passage which is continuously further approximated to a horizontal line. In order to attain this, small penalties must then actually be excepted in production. These are, however, smaller, on the whole, than the penalties which occur without the method of the invention.

A further increase in the exploitation of the bale opening machine can be achieved in that the opening of the bale row always takes place during the first pass along the row of bales while simultaneously detecting the height profile, with the opening member being controlled to constantly follow the bale height during the first passage.

As previously mentioned, the determination of the height of the bales while simultaneously removing fiber flocks from the bale surface is known, per se, from DE PS 33 35 793. For this purpose two sensors are, however, used which are arranged at different heights and parallel to the surface of the bale row. The sensors do not enable either a very accurate determination of the height profile of the fiber bales or a determination of the hardness of the bales.

Through the opening of the bale row during the first pass along the row of bales, the idle time for scanning the height profile without simultaneously opening fiber flocks is avoided according to the invention. Although the opening member is controlled to constantly follow the bale height during the first pass, in order to avoid sudden vertical steps leading to overloading of the opening machine, it is possible to obtain ideal pass height curves for subsequent passes, taking account of the height profile and the corresponding hardness profiles determined during this first pass. In this way, approximately maximum production is obtained, on the one hand, and a minimum residual height of the bales during the last pass is obtained, on the other hand.

In order to preset and maintain the desired value for the flow of flocks of the opening machine, which simultaneously represents an accurate measure for the production of the bale opening machine, one preferably proceeds in accordance with the invention in such a way that the actual value of the flow of flocks is determined as a result of the in-feed depth and of the respective hardness signal and the in-feed depth is regulated in order to maintain the preset flock flow or a maximum flock flow. In this process, the actual value of the flock flow corresponds to the product of the in-feed depth with the hardness signal. In addition, of course, geometrical constants, such as the width of the bale row and the speed of movement of the bale opening machine along the bale row, must be taken into account.

Since one selects the in-feed depth by means of the invention in accordance with the respectively prevailing bale hardness, the accuracy of the fiber mixture which arises from the various components is improved, in particular in spinning mills in which the mixing conditions are primarily determined through the working of the bale opening machine.

The method of the invention also offers the possibility of determining the start or end of the row of bales and optionally also the presence and the length of gaps between the bales of the row through the sensor. At the start and end of a bale row, or in gaps, the sensor signal is reflected from the floor or from the bale carrier which has a known distance from the measurement sensor and which can thus be directly determined through the sensor signal. Furthermore, the floor or a bale carrier represents a very hard object in comparison to the bales so that in this region the amplitude fluctuations of the sensor signal are low, whereby the presence of the bale or bale support, and also the vertical boundaries of the bales, can be determined from the sensor signal.

For acoustical measurement sensors at least a very hard article, such as, for example, the ground or a bale carrier, also leads to a double signal since the acoustic signal radiated from the measurement sensor is reflected with relatively small losses at the floor or at the carrier, is reflected again at the measurement sensor or at the arm, and is subsequently received again by the measurement sensor after a further reflection at the floor. The double signal, i.e., the received signal after the first reflection and the received signal after the second reflection at the floor, represent a special characteristic for the floor (or for a bale carrier).

In order to bring the height profile or the hardness profile into correspondence with the position of the opening member along the bale row, the method of the invention is preferably so characterized that a signal proportional to the distance of travel of the opening member along the row of bales is generated and is taken into account by the computer in the computing of the height profile and/or of the in-feed depth profile and/or of the hardness profile, respectively.

The corresponding signals proportional to the distance of travel of the opening member can, in the case of a form-locked and slip-free drive of the tower along the bale row, for example, by means of chains and chain sprockets, be generated by the drive itself. By way of example, a toothed wheel or an aperture disk can be coupled with the shaft of the drive motor for the travelling movement, with the gear wheel or the apertured disk serving as a count generating wheel and functioning together with an initiator as the pulse transducer, the pulses of which are fed via a line to the microprocessor. These pulses then represent the distance of travel of the opening member, i.e., they are proportional to the latter. Thus, the microprocessor or the control is at any time informed over the precise position of the opening member in the longitudinal direction of the bale opening machine.

With bale opening machines which run on wheels, where slip must be feared, the required signals can be reliably determined by a distance of travel determination device which is independent of the slip. By way of example, known distance of travel measuring devices in the form of magnetic strips and linear measuring devices can be used such as are used with the guides of machine tools.

Such known magnetic strip or linear measurement devices are, however, relative complex so that their use in bale opening machines in which the tower can move over a considerable distance, for example 20 meters (m) or more, can lead to considerable costs.

It is thus a further object of the present invention to provide a distance of travel measuring device, in particular for a bale opening machine, which determines the actual longitudinal position of the movable part, for example, of the tower of the bale opening machine, independent of any slip of the drive system which may occur, with the distance of travel measuring device being robust, free of servicing and priceworthy, and also relatively insensitive to contamination and damage.

In order to satisfy this object, the present invention provides a distance of travel measuring device, in particular for a bale opening machine with a non-slip drive system and with a travelling tower which can be moved by means of the drive system along a row of bales, the distance measuring device including an elongated member which extends along the bale row and which is either fixedly arranged or is connected to the tower and moves with the latter, by a sensing means which, depending upon the arrangement of the elongated member, is either arranged on the movable tower or at a specific position along the bale row, which senses the elongated member, free of slip during the travelling movement of the tower, and which transmits a pulse each time the tower covers a specified step, and by a counting means which counts the pulses and generates a signal proportional to the path of travel.

In one embodiment, the elongated member comprises a rail and the sensing device comprises a wheel which is arranged on the tower and rolls along the rail free of slip, with a pulse transducer being coupled with the wheel for the transmission of pulses. Under some circumstances, it is sufficient here to provide a simple wheel with a rubber tire for the slip-free sensing of the rail, because the rubber wheel does not have to transmit any substantial torques and is thus not liable to slip. This simple embodiment has the particular advantage that it can be made very economically. If, however, one must fear that slip could eventually arise here, for example, as a result of dimensional tolerances of the rail, then the rail could be formed as a rack or toothed bar and the wheel could be formed as a toothed wheel which meshes with the rack or bar.

A further possibility is to form the elongated member by a chain which is secured to the tower and which is deflectable around deflection devices at both ends of the bale row during a recirculating movement caused by the movement of the tower along the bale row. Here, a sensing device is used which is formed by a chain sprocket driven by the chain, with a pulse transducer for the transmission of pulses being coupled with the chain sprocket, which is arranged at a fixed position of the bale row. A very economical arrangement is then achieved when the chain sprocket is formed by one of the deflection devices.

A further possibility lies in forming the elongated member as a structure having regularly repeating narrower and broader regions, for example by an apertured rail, or by a fixedly tensioned chain, or by an elongate structure having teeth and gaps, with this structure being sensed by a light barrier or inductive sensing device, or by a mechanical switch device, the receiving circuit of which transmits the pulses. An elongate structure of this kind, which modulates the output signal of the sensing device, can in particular extend along the flock transport channel (pneumatic transport duct) of a bale opening machine and can be secured to the latter. A mounting of the elongate structure of this kind saves space and is generally possible without giving rise to disturbing restrictions with regard to the other necessary parts of a bale opening machine.

In this manner, a distance of travel measuring device in accordance with the invention can in particular be subsequently mounted on an existing bale opening machine.

A particularly preferred embodiment of the distance of travel measuring device of the invention includes an apparatus in which the repetition length of the structure is relatively large, for example, more than about 10 cm, and that with a known, preferably constant, speed of travel length measurements, in the region between two sequential pulses can be carried out by an interpolating means. Through the use of a structure with a relatively large repetition length, this structure can be made very economically. The invention, however, makes it possible to measure units of length which are substantially smaller than the repetition length.

In order to monitor the accuracy or validity of the individual measurements, a means is preferably provided for monitoring the time interval between the pulses. If, for example, the tower runs at a known constant speed along the bale row, then this monitoring means must always find the same time interval between two sequential pulses. If the device finds that this time interval is not constant, then the validity of the length measurements interpolated between the two positions of the structure which generated the associated pulses are suspect. These values can thus be ignored or, depending upon the purpose of the measurements, these values can be weighed differently so that the inaccuracy is taken into account. A device of this kind has the advantage that the measurement can be carried out again with the expected accuracy with the next pulse because the extent of faulty measurements, which arise through interpolation errors, is restricted as a result of the rigid association between the pulses and the parts of the structure which generates the pulses.

Even if the bale opening machine is accelerated or braked in certain sections of the bale row, or travels with a slower speed along the bale row, then these changes in speed can be taken into account by the interpolating means so that precisely interpolated length measurements are also possible during these operating phases.

It is of particular advantage when the counting means and/or the interpolating means and/or the monitoring means is/are formed by a microprocessor. The counting, interpolating and monitoring functions can then be realized by appropriate programming of the microprocessor, preferably the microprocessor which is responsible for the control of the entire bale opening machine, whereby the available information can be exploited and evaluated in the best possible manner. By way of example, an interpolating means realized by the microprocessor will always "know" whether an acceleration or braking of the tower movement had been initiated and could take account of these different operating states in carrying out the interpolation.

As shown in by FIG. 1, a machine 1 for opening fiber flocks has an opening member 2, a machine frame 3 and a flock transport system 4. The opening member 2 itself includes an arm or a housing construction 5 in which a rotating opening roller 6 is drivably journalled. The fiber flocks which are removed by the opening roll 6 from the fiber bales 7 are received through the housing construction 5 and are conveyed into the flock transport system 4 via paths which are not shown.

The housing construction 5 can be moved up and down in the direction of arrow A by means of rollers 9 which are secured to the housing construction 5 and which are guided in guide rails 8 of the machine frame 3. In FIG. 1 only the one roller pair and only the one rail 8 are, however, shown. The rollers and rail which are provided on the other side in the same manner are not visible.

In other respects, the housing construction 5 has a follower 10 which is fixedly connected with the chain 11 of a chain drive 12.

The chain drive 12 furthermore includes an upper rotatably journalled chain sprocket 13 for the deflection of the chain 11 and a lower chain wheel 14 for the drive of this chain 11. The lower chain wheel 14 is fixedly rotatably mounted on a drive shaft 15 of a transmission 16. An electric motor 17 which is connected to the transmission serves as the power source and is formed as a stop motor.

The chain drive 12, the transmission 16 and the electric motor 17 are jointly called a lifting device.

A toothed wheel 19 is rotationally fixedly mounted on the upper shaft end 18 of the motor 17 in FIG. 1 and forms a counting wheel which cooperates with an initiator 20 to form a pulse generator, with the pulses of the initiator being supplied via a line 21 to the microprocessor 22. The initiator 20 is of a form which can be commercially obtained and transmits one pulse each time a tooth of the toothed wheel moves past. The initiator 20 is of fixed location.

For the sensing of the upper and lower end positions of opening member, an upper end switch 23 and a lower end switch 24 are provided on the machine frame 3.

The upper end switch 23 is actuated by an upper surface 25 of the follower 10 and the lower end switch 24 is actuated by a lower surface 26 of the follower 10. The upper end switch 23 feeds its pulse via a line 27 into the microprocessor 22 and the lower end switch 24 feeds its pulse via a line 28 into the microprocessor 22. A distance measuring sensor 30 is mounted on the front side of the housing or boom 5, i.e., on the right hand side in FIG. 2. This sensor comprises combined sender/-receiver units and operates in the present embodiment on an ultrasonic basis. This distance measuring sensor can, for example, e a sensor of the Siemens company type Sonar/Bero 3RG6044/3 MOO. Sensor 30 can, however, operate with a different measuring principle, for example, an optical sensor or a sensor which operates with radar waves.

Figure 3:
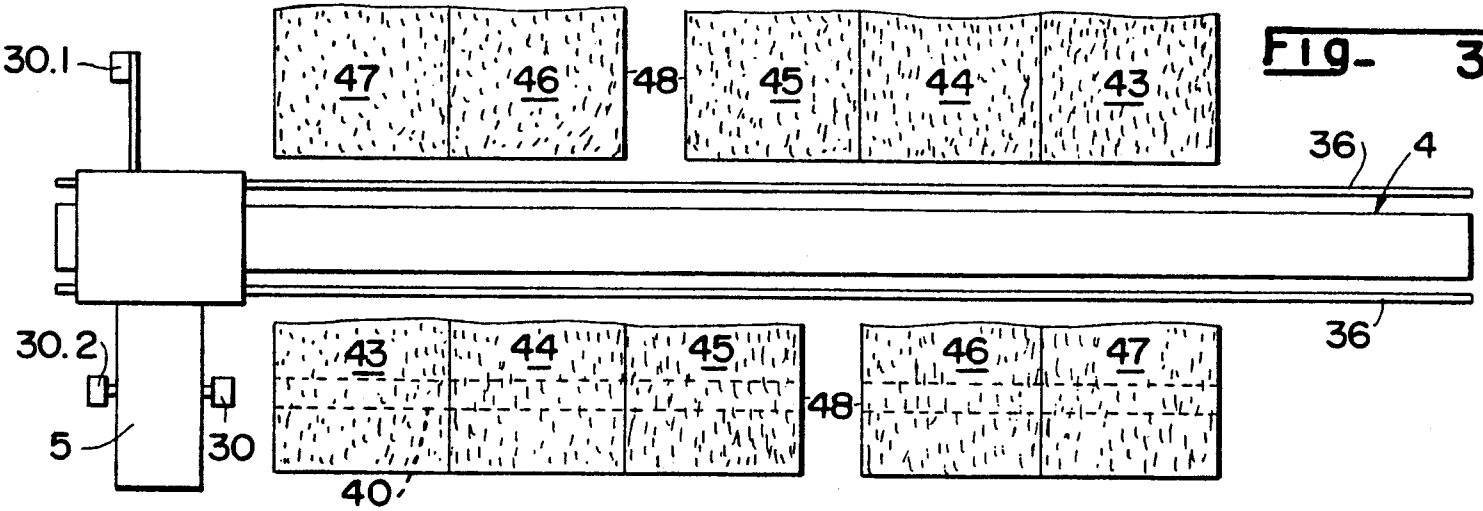
FIG. 3 is a plan view of the bale opening machine of FIG. 1.

A measurement beam 31 is directed onto the surface 32 of the row of bales 7, i.e., perpendicular thereto, with the measurement beam engaging a strip of the surface which is 15 to 20 centimeters (cm) wide and which, as shown in FIG. 3, is arranged approximately at the middle of the bale row. Several distance measuring sensors could, however, also be provided which detect different strip regions of the surface. From the signals of several sensors, mean values for the bale height and hardness could optionally be generated. The distance signal which is generated in the receiver part of the distance measuring sensor is passed via a line 33 to the microprocessor 22.

A further line 34 connects the electric motor 17 to the microprocessor 22.

The machine frame 3 is movable along the row of fiber bales 7 and along and above the flock transport system 4 by means of drivable wheels 35 which are secured to the machine frame and which run on rails 36 mounted on the floor 37 of the spinning mill. As the wheels 35 are elements which are subject to slippage, a special device is provided in this embodiment in order to determine the precise longitudinal position of the tower 3 along the row of bales 7. In this case, this is a light barrier 38 which consists of transmitter and receiver parts which are arranged on opposite sides of an apertured rail 39. The apertured rail 39 has a plurality of apertures which are spaced apart at the same intervals, with the light barrier transmitting a signal pulse each time it passes a hole, and with the signal pulse being transmitted to the microprocessor 22 via the line 41. The microprocessor 22 is able to determine the precise position of the tower along the row of bales from these signals and also from signals which correspond to the direction of travel of the tower along the row of bales and which, for example, can be derived from the drive motor for the longitudinal movement.

Beneath the arm 5, there is also located a grid 40 with individual grid bars between which the individual toothed wheels 41 of the opening member 6 are located. Such grid bars are well known per se and are, for example, described in the Applicants' German Applications P 38 20 427.4 and P 38 27 517.1.

Figure 2:
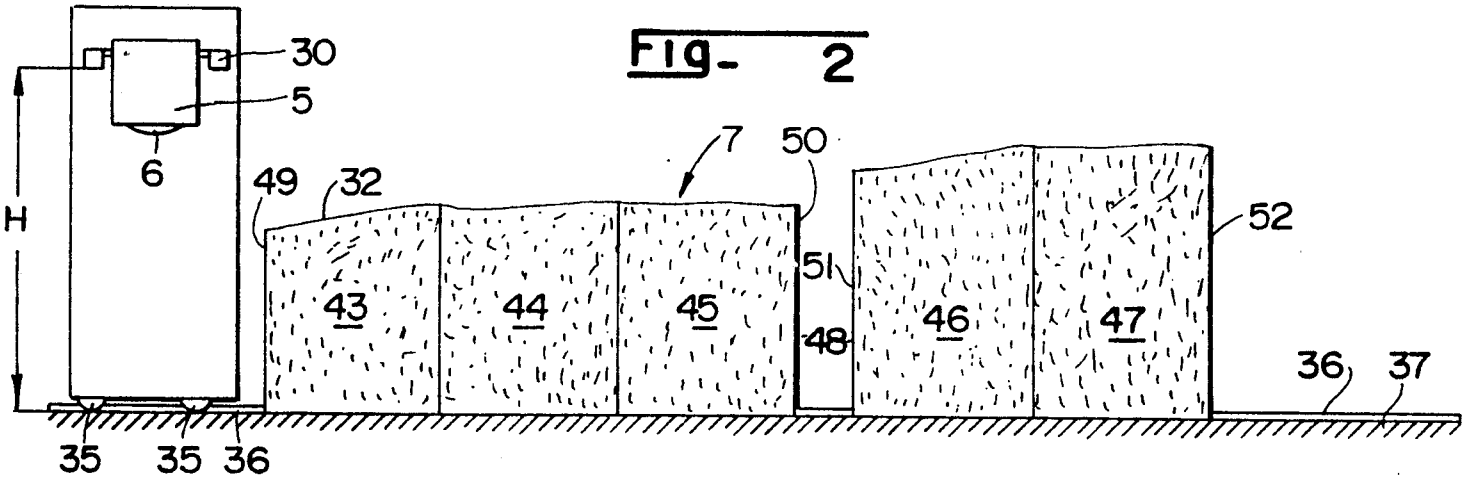
FIG. 2 is a side elevation view of the bale row of FIG. 1 in the region of the bale opening machine of the invention.

As can be seen from FIG. 2, the bale row in the present example includes five bales 43 to 47 which have different heights. As an example, the highest bale 47 is arranged at the right side of FIG. 2 and the lowest bale 43 is arranged on the left hand side of FIG. 2. The bales 44 and 45 are of the same height and somewhat higher than the bale 43, and the bale 46 has a height which lies between that of the bales 45 and 47. In other respects, a gap 48 is shown between the bales 45 and 46 for the purpose of this illustration, so that vertical bale boundaries 49 to 52 are provided at the start of the row of bales, at both sides of the gap 48 and at the end of the row of bales 7, respectively.

FIG. 3 shows that a similar row of bales can be arranged on the other side of the bale opening machine, insofar as the tower 3 is a rotatable tower which can also operate on the second side of the row of bales.

The reference numeral 30.1 also makes it clear that a height sensor can also be arranged on the opposite side of the tower from the boom 5, so that during the opening of the fiber flocks from the lower row of the FIG. 3, the height profile and also the hardness profile of the bales on the upper row can be determined in a time saving manner with the sensor 30.1.

Figures 4A, 4B, 4C:
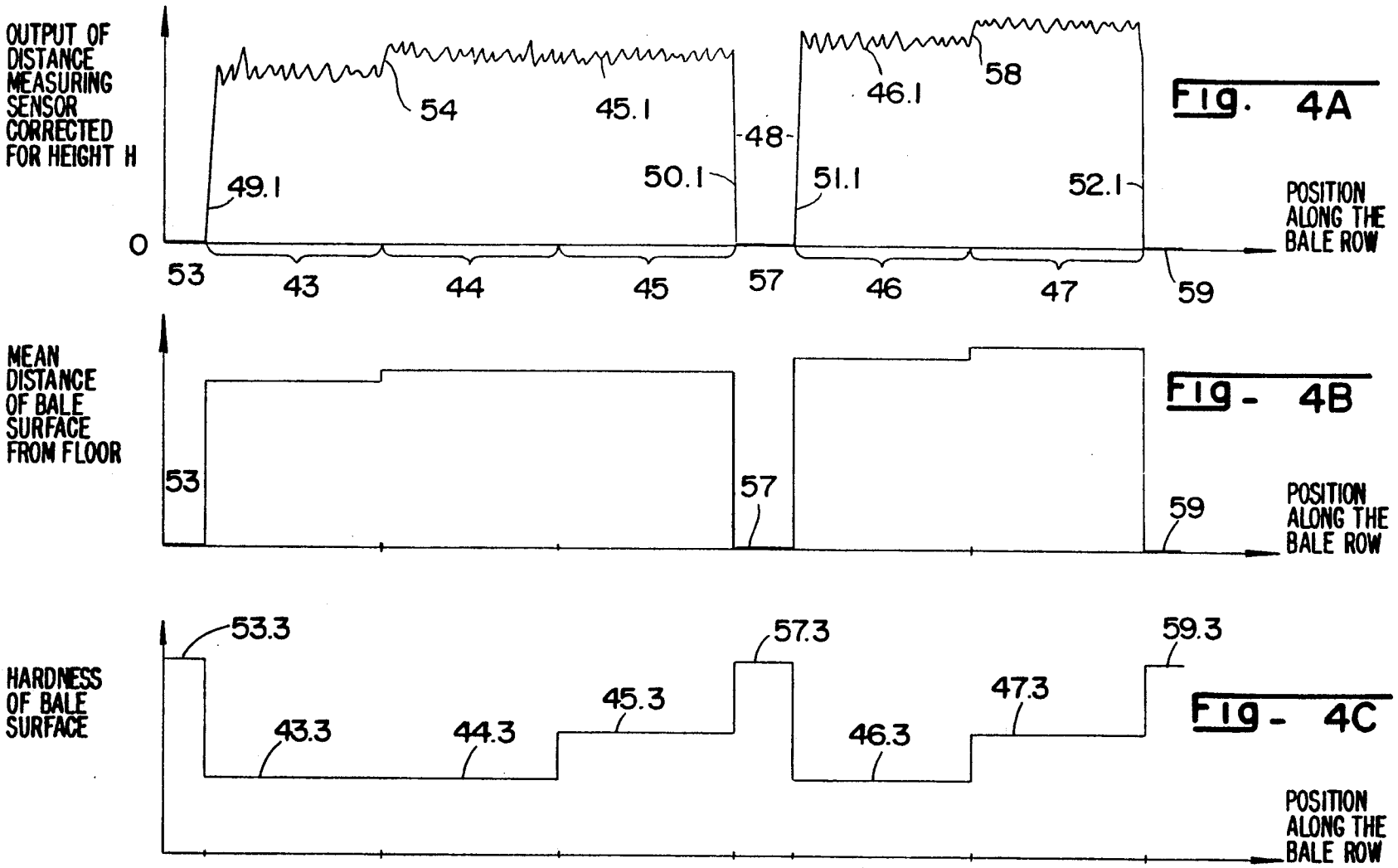
FIG. 4A is a graphic representation of a sensor signal during sampling of the height profile of the row of bales of FIG. 2.
FIG. 4B represents the height profile obtained from the sensor signal of FIG. 4A.
FIG. 4C represents the hardness profile obtained from the sensor signal of FIG. 4A.

FIG. 4A shows the distance measuring signal of the measurement sensor 30 (or 30.1, respectively) during a measurement passage above the row of bales which has been erected. The measurement sensor 30 determines the distance to the opposite surface by measurements of the transit times of ultrasonic waves from it to the oppositely disposed surface (floor 37 or bale surface 32) and back. In this measurement process, the arm 5 with the sensor 30 is located in this embodiment at a constant height H above the floor 37 and the output signal of the distance measuring sensor is subtracted from this height H so that the fluctuating signal of FIG. 4A actually represents the height of the bale surface above the floor. It is, however, not absolutely necessary for the measurement process to be carried out at a constant height of the arm above the floor, since the height of the arm is known per se as a result of the signal transducer 20, so that the computer can always determine the height of the bales above the floor 37 from the distance measuring signals. In other words, the sensor 30 can directly determine the height profile of the bales which are to be worked off during bale opening. 30.2 shows a further sensor corresponding to the sensor 30 which can measure the height profile after opening.

FIG. 4A is shown to the same scale as FIG. 2 so that the association between the individual bales and the amplitude of the output signal of the distance measuring sensor 30 (30.1, 30.2, respectively) is clearly evident.

First of all, the distance measuring sensor is located at the left hand side of FIG. 4A at a level H above the floor and the actual output signal of the measurement sensor gives the height H. The output signal is, however, subtracted from the height H, so that the corrected output signal of the sensor 30 in the region 53 starts at 0 (H−H=0). As the floor 37 is hard so far as sound is concerned and thus reflects a high proportion of the beam which is incident on it, a reliable distance measurement results and the measurement signal, and thus also the corrected measurement signal, has no or only very small fluctuations in the region 53.

At 49.1 the beam of the sensor 32 now reaches the bale boundary 49, whereby the distance between the sensor 32 and the reflecting surface, here the surface of the bale 43, is suddenly shortened and the amplitude of the signal as a whole increases. As the surface 43.1 of the bale 43 is soft so far as sound is concerned and is moreover a rough surface, the signal of the distance measuring sensor exhibits large fluctuations with a relatively high frequency. The amplitude fluctuations are not caused only by fluctuations of the roughness of the surface of the bale 43, but rather by the fact that the measuring sensor always attempts to deliver an unambiguous measurement result and, as a result of the imprecise reflection of the beam of sound at the surface of the bale 43, which is soft so far as sound is concerned, always delivers fluctuating measurement results. This fluctuation takes place at a frequency which is considerably higher than the frequency which is shown in FIG. 4A simply by the way of illustration.

At 54, the measurement beam of the sensor 30 has attained the boundary between the bale 43 and the bale 44 and an upward jump in amplitude occurs, while the signal itself has similar amplitude fluctuations to those at the bale 43. At the transition to the bale 45, the height the mean value of the signal remains approximately the same as with the bale 44, however, the amplitudes of the fluctuations are somewhat smaller. These smaller fluctuations, for example, at 45.1, signify that the upper surface region of the bale 45 is harder than the corresponding regions of the bales 43 and 44.

After moving past the bale 45, the beam of the sensor 30 now strikes the vertical bale boundary 50.1, i.e., the sensor once again measures the distance between it and the floor 37, which is why the amplitude of the received signal at 57 drops back to zero, i.e., to a level which corresponds to the level 53. After passing the gap 48, i.e., at the vertical bale boundary 51.1, the amplitude of the height signal increases once again and, indeed increases to a mean value which lies still higher than the corresponding mean value of the signal in the region of the bale 45. The signal also has considerable amplitude fluctuations 46.1, which point to the fact that the bale 46 is also relatively soft. At 58, the boundary between the bale 46 and the bale 47 is reached and the amplitude of the distance measuring sensor increases once again, which is also correct because the bale 47 is reached and the amplitude of the distance measuring sensor increases once again, which is also correct because the bale 47 is the highest bale of the bale row 7. At the end of the row of bales, the amplitude of the height signal again drops, at the vertical bale boundary 52, which is characterized in FIG. 4A by 52.1.

The computer 22 now derives a mean value from the distance signal of FIG. 4A and the result of this mean value formation is shown in FIG. 4B as a height profile. Mean value formation by means of a computer is well known per se which is why it is not specially described here. The mean value signal represents a very good reproduction of the height profile of the row of bales 7 of FIG. 2, which is also the intention.

The distance signal is also processed further by the computer 22 in order to obtain the hardness profile of FIG. 4C. This evaluation takes place in such a way that the algebraic sum of the amplitude fluctuations from the mean value is determined at several adjoining regions and the reciprocal values of these algebraic sums are then formed. These reciprocal values represent the hardness of the individual regions. In the regions 53, 57 and 59, the distance measuring signal hardly has any fluctuations, since the floor 37 reflects well and the latter is termed a hard article, which is why the hardness signal in these positions has a high amplitude 53.3, 57.3 and 59.3. The bales 43 and 44 and also 46 have approximately the same size of hardness and this hardness is low, as already explained, which is why the hardness is shown to be relatively low in the corresponding regions 43.3, 44.3 and 46.3 of the hardness profile of FIG. 4C. In contrast, the bales 45 and 47 have a greater hardness and in both cases this hardness is of a comparable size which is why the hardness signal has a higher amplitude in regions 45.3 and 47.3.

Figure 4D:
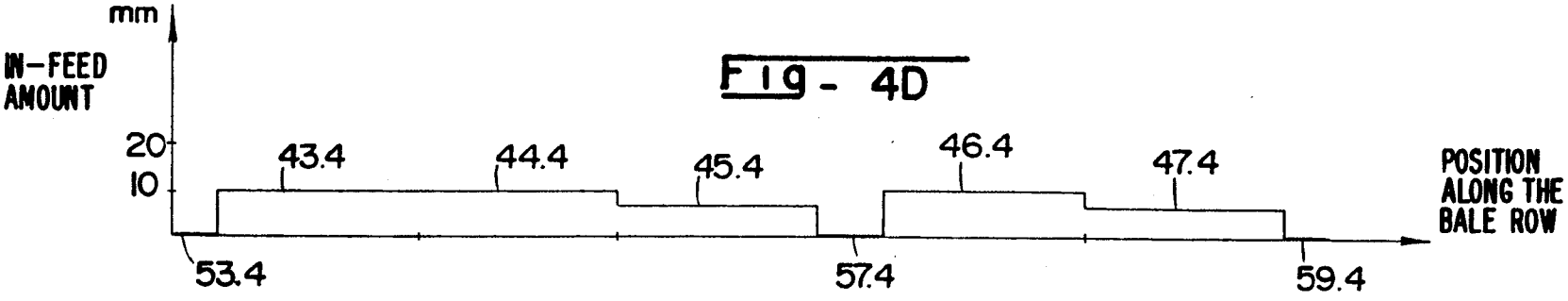
FIG. 4D represents the in-feed profile obtained from the hardness profile of FIG. 4C.

As the hardness of the bales in the surface region is directly proportional to the density in these regions, and the machine is to be set to an in-feed depth, i.e., opening depth corresponding to the reciprocal value of the hardness for a desired production rate, the computer 22 determines the in-feed depth profile of FIG. 4D, taking account of the relevant constants that are present. The in-feed is of the same size for the bale regions 43.4, 44.4 (because the hardness is of the same magnitude) and has a relatively high amount of 10 mm. The in-feed depth at 46.4 is also of the same size for the bale 46. In contrast, the in-feed depth has been reduced to approximately 5 mm in the regions 45.4 and 47.4, since the surfaces of these bales are harder. The in-feed depth profile of FIG. 4D also include regions 53.4, 57.4 and 59.4, where the in-feed is zero because the floor is very hard and because no material is to be removed from the floor.

From the mean value of the height profile of FIG. 4B and from the in-feed depth profile of FIG. 4D, one can obtain a control command for the drive of the motor 17 from the corresponding values in order to set the desired height of the opening member during opening of each bale of the bale row. That is, the in-feed depth is subtracted point for point from the height. In regions where the in-feed depth is zero, the same height of the opening member is retained.

Figure 4E:
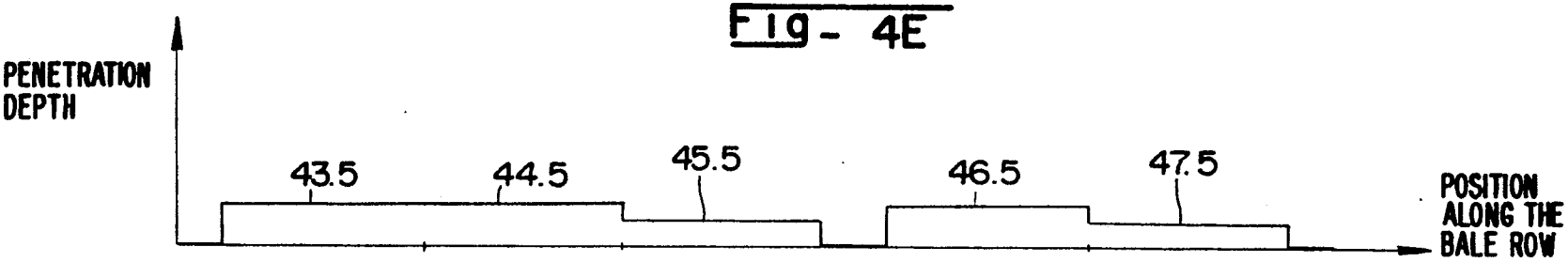
FIG. 4E represents the penetration depth profile derived from the hardness profile of FIG. 4C.

It can be entirely sensible to set the penetration depth of the opening member 6, i.e., the distance between the radially lower-most points of the toothed discs 81 and the grid bars 42 in accordance with the hardness of the bales. The penetration depth should be smaller for harder bales and can be somewhat higher for softer bales. The corresponding penetration depth profile for the bale row of FIG. 2 is shown in FIG. 4E and here the individual segments of the profile are also brought into correspondence with the individual bales by means of the numbering of the bale row and the suffix point 5.

Figure 5:
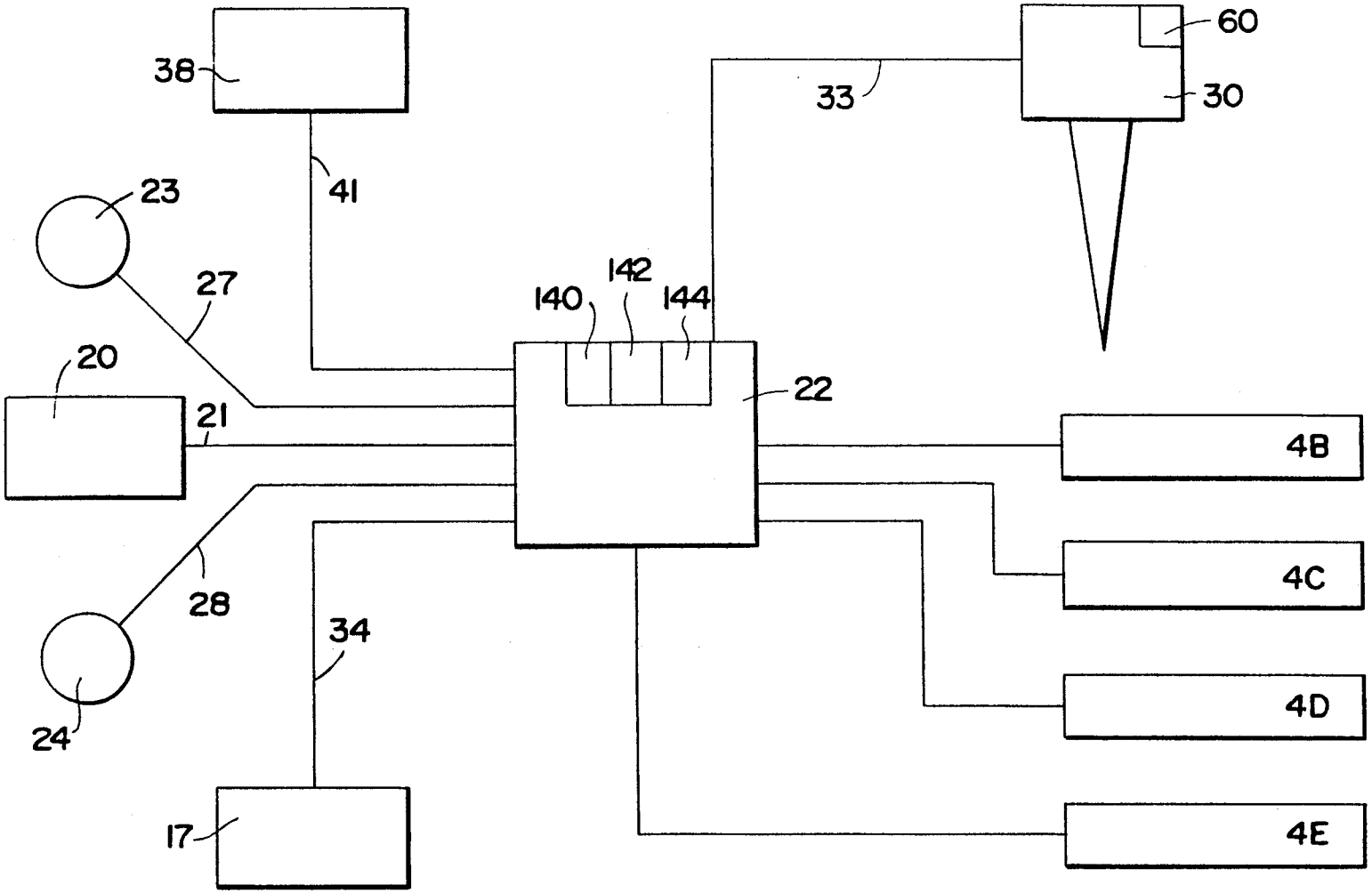
FIG. 5 is a highly schematic block diagram illustrating the signal evaluation in a bale opening machine in accordance with FIG. 1.

To better explain the manner of operation of the computer 22 in connection with the derivation of the height profile, of the hardness profile, of the in-feed depth profile and of the penetration depth profile reference is now made to FIG. 5. The signals for the vertical position of the opening member 6 or of the boom 5 are, as already described, found by the computer as a result of the signals from the lines 27, 28 and 21, and the computer transmits control commands for the height of the opening member to the motor 17 via the line 34. The signals of the light sensor 38 are read into the computer via the line 41. If necessary, further values can be extrapolated in order to attain a finer resolution. In each case, with either a read-in signal of the length sensor or with a value interpolated in advance, the sensors are activated by the computer in order to store the measured value which is read back directly from the sensor.

The distance measuring sensor 30 carries out distance measurements at regularly repeating time intervals and stores these dimensions temporarily in an intermediate store 60. The computer 22 reads the stored values via the line 33 at points in time which are determined by the signals of the length sensor 38. From the values which are read into the computer in this way, the computer then determines the height profile 4B by average value formation, the hardness profile 4C by the algebraic addition of the amplitude fluctuations, the in-feed depth profile from the reciprocal values of the hardness profile and the penetration depth profile in accordance with the hardness profile and taking account of constants which are retained in the computer. The profiles are then stored in memories of the computer 22 and can be permanently stored if desired.

Figure 6:
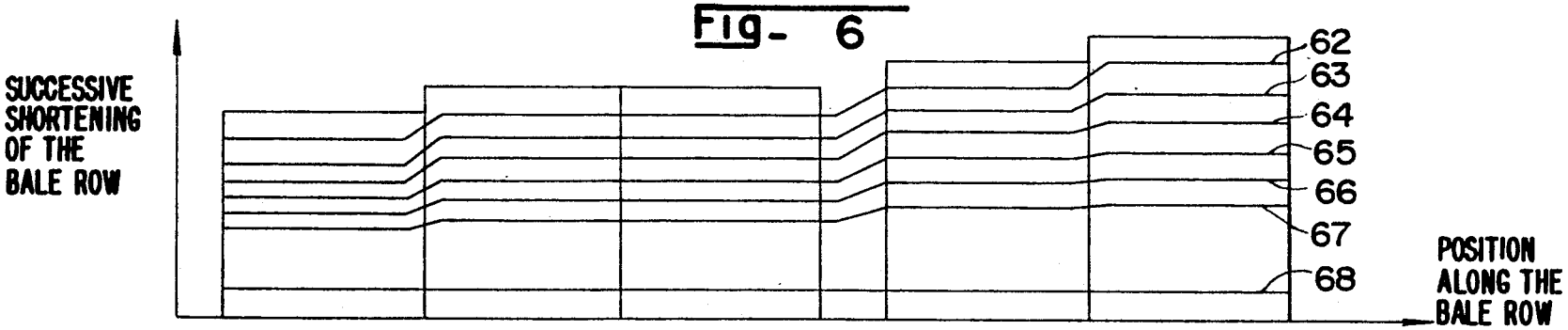
FIG. 6 is a schematic representation of the successive opening of the bale row of FIG. 2.

FIG. 6 shows how the height profile of the row of bales 7 is worked off during successive passes. In FIG. 6, one assumes that opening takes place simultaneously with the measurement of the height profile and first attempts to maintain a constant opening depth so that the computer can in any event correctly determine the data. This first passage is designated with 62. The constant opening depth is selected here to be so low that no overloading of the opening machine can occur. Thereafter, the computer determines that desired in-feed depth for each bale during the next passage and checks whether to maintain these in-feed depths and whether the height profile is changed in an undesirable manner, so that larger vertical steps can be taken. If this is not the case, then the row of bales is opened in accordance with the computer in-feed depths in accordance with the lines 63 . . . 67. If, however, apparently larger steps will arise, then the maximum is removed from the higher positions and somewhat less from the lower positions so that the height profile gradually becomes smoother. The object is to obtain a horizontal line 68 at the lower end of the bales during the last passage, and, based upon the height profile and penetration depth profile during passage of the tower, the computer appropriately controls bale opening so that all bales or all bale remainders are of the same height, which is a good precondition for the opening of the next row of bales which has to be erected.

Figure 7:
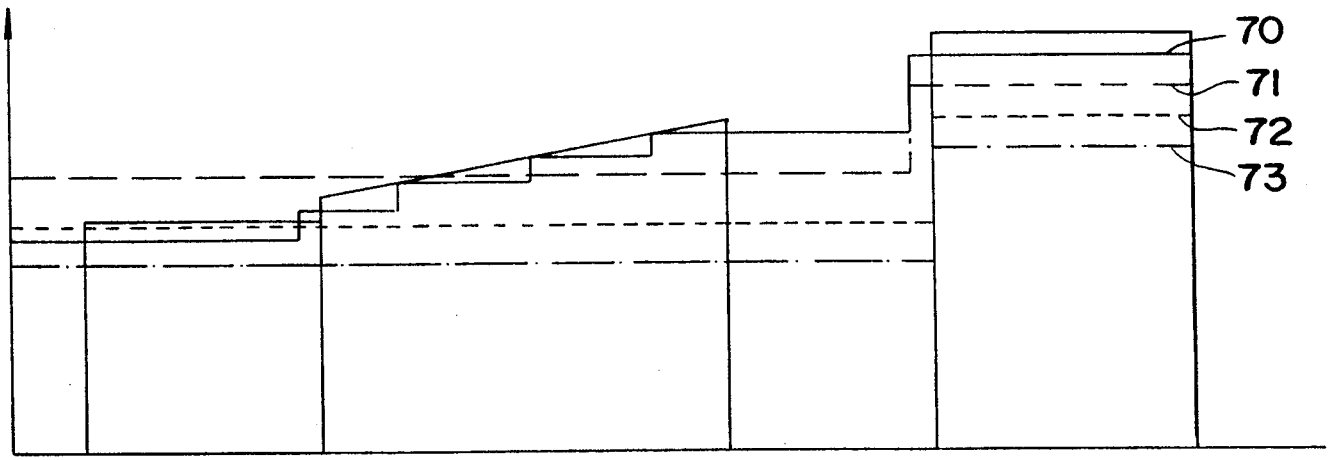
FIG. 7 is a schematic representation of an alternative method for the successive opening of a row of bales.

A simplified embodiment of the machine is also conceivable. In this embodiment, it is not possible, for reasons of the drive technology, to keep the drives for the vertical adjustment and the sideways advance in operation simultaneously (see FIG. 7). Thus, in a first pass (reference numeral 70) the opening member is guided step-wise along the surface of the bales. In the second passage (reference numeral 71) and eventually in the third passage (reference numeral 72) the opening member is set to a constant height at each bale, the value which is so calculated by the computer that on the one hand a maximum opening depth is not exceeded, but on the other hand the production is kept as high as possible. A disadvantage of this however, is the fact that a small production penalty must be tolerated in this region. However, at the fourth passage (reference numeral 73), at the latest, the group of bales has been levelled out. It is thus not very frequently necessary to switch off the advance motor in order to change the height of the opening member.

Whether one can use this method will depend in part on whether the mixing ratio of the fibers are to be determined by the bale opening machine itself or whether the individual components will be separately opened and supplied to individual mixing chutes, with the mixing ratio of the flocks finally being determined in the mixing station and not by the flock opening. If impermissible bale heights are present which in no way permit converging opening, then this can be indicated by the computer, whereby the operator can be instructed to at least partially open or lay over the bales manually in order to provide more favorable conditions.

As previously mentioned, a measuring system is preferred which ensures a slip-free measurement of the longitudinal position of the tower along the bale row and, indeed, independently of whether slip occurs between the wheels and rails in operation during the driving of the tower. In the foregoing description of the invention, the only specific embodiment which has been mentioned is a light barrier 38 which cooperates with an apertured rail 39.

Figure 8:
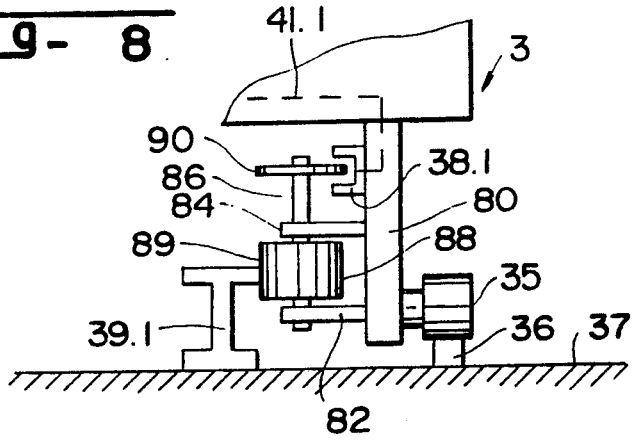
FIG. 8 is a schematic representation of a slip-free length measuring device comprising a rail and a wheel.

A third possibility is shown in FIG. 8. Here, the rail 39 is replaced by a rail 39.1 with an I-shaped cross-section. Two flanges 82 and 84 are fixedly mounted, for example, by welding, onto a vertically downwardly extending arm 80 of the machine frame 3 opposite to the rail 39.1, namely, on the arm which carries the running wheels 35. A shaft 86, which likewise extends vertically, is rotatably journalled with respect to the flanges 82, 84. A rubber or similar type of wheel 88 is rotationally fixedly located on the shaft 86 and is lightly pressed against the long side 89 of an edge of one of the flanges of the I-shaped rail 39.1. During a travelling movement of the tower perpendicular to the plane of FIG. 8, the rubber wheel 88 thus rolls along the longitudinal edge 89 and leads to a slip-free rotary movement of the shaft 86.

At the upper end of the shaft 86, there is located an apertured disk 90, i.e., a disk with a series of holes in its peripheral region, so that a rotation of the rubber wheel leads to a rotation of the apertured disk 90 which is likewise rotationally fixedly connected to the shaft 86. A light barrier 38.1 with transmitter and receiver parts engages around the peripheral region of the apertured disk 90 and thus generates a pulse sequence corresponding to the sequence of holes and webs in the apertured disk upon rotation of the apertured disk on the shaft 86. This pulse sequence is supplied via a line 41.1 to the microprocessor 22 and is processed there in accordance with the signal 41 of FIGS. 1 to 5.

Figure 9:
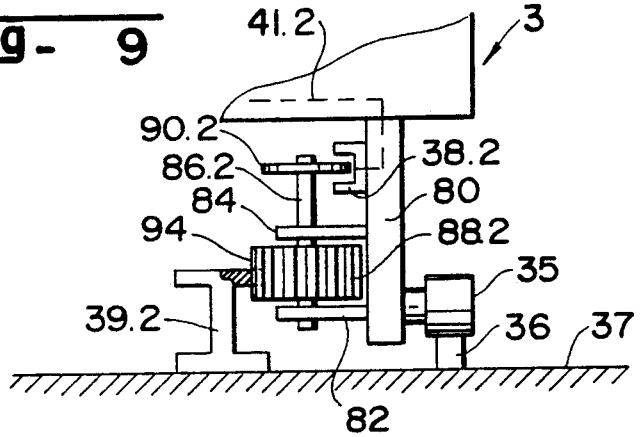
FIG. 9 is a schematic illustration of a similar embodiment to that of FIG. 8 in which, however, the rail is formed as a toothed rack and the wheel is formed as a gear wheel.

If, however, a certain degree of slip must be expected in the embodiment of FIG. 8, for example, as a result of manufacturing tolerances or inadequate guidance of the tower along the row of rails (an adequate guidance of the tower along the row of bales and in the transverse direction is normally ensured by the cooperation between the wheels 35 and the rails 36), then a somewhat modified embodiment can be selected, as illustrated in FIG. 9, in which the rubber wheel 88 is replaced by a toothed wheel 88.2. The gear wheel 88.2 then meshes with a row of teeth 94 on the rail 39.2. In other words, the rail 39.2 is formed as a toothed rack. In accordance with the embodiment of FIG. 8, the toothed wheel 88.2 is here rotationally fixedly mounted on the shaft 86.2, which drives the apertured disk 90.2, which is likewise rotationally fixedly connected to the shaft 86.2. Again, in correspondence with FIG. 8, a light barrier 38.2 generates a pulse sequence which is applied via the line 41.2 to the microprocessor 22.

Figure 10:
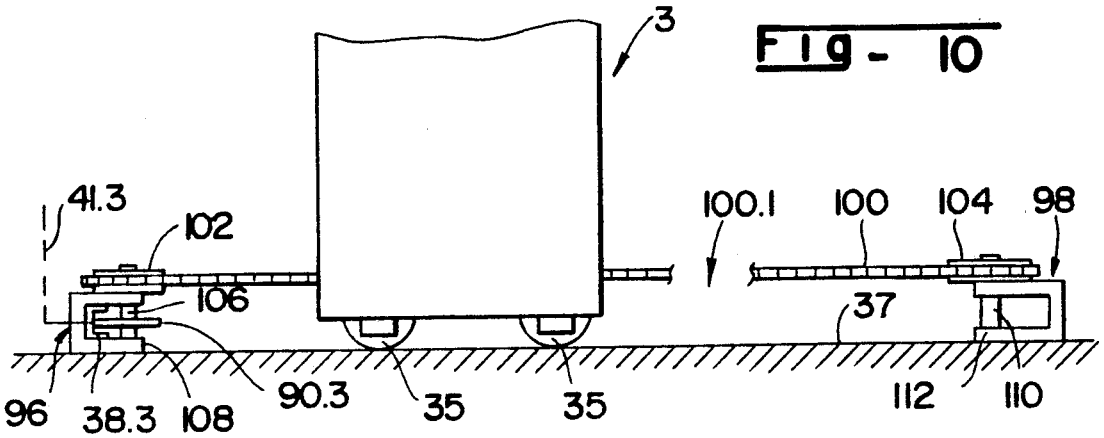
FIG. 10 is an alternative embodiment of a slip-free length measuring device comprising a recirculating chain which is secured to the tower of the bale opening machine.

A further possibility for the slip-free length measurement is shown in FIG. 10. FIG. 10 shows a side view of a bale opening machine in which the tower 3 runs between two end positions 96 and 98. The propulsion of the tower takes place, as in the previous embodiments, via the wheels 35. Above the floor 37, there is located a recirculating chain 100 which is secured to the tower 3 at one position and which runs at its two ends over respective deflecting wheels 102, 104. The toothed deflecting wheel 102 is thereby rotationally fixedly mounted on a shaft 106 which is rotatably journalled in a C-shaped mount 108. The toothed deflection wheel 104 is mounted in a corresponding manner on a shaft 110, which is rotatably journalled in a mount 112. In order to show that the chain is very long, it is interrupted at the position 100.1 in the drawing of FIG. 10. An apertured disk 90.3 is provided on the shaft 106 in correspondence with FIGS. 8 and 9 and is rotationally fixedly connected to the shaft 106. A light barrier 38.3 is located within the C-shaped mount 108 and transmits a pulse sequence via the line 41.3 to the microprocessor 22 upon rotation of the aperture disk. With movement of the tower 3 along the row of bales, the corresponding movement of the chain leads to a rotational movement of the shaft 106, with this rotational movement being determined in a slip-free manner by the light barrier 38.3.

Figure 11:
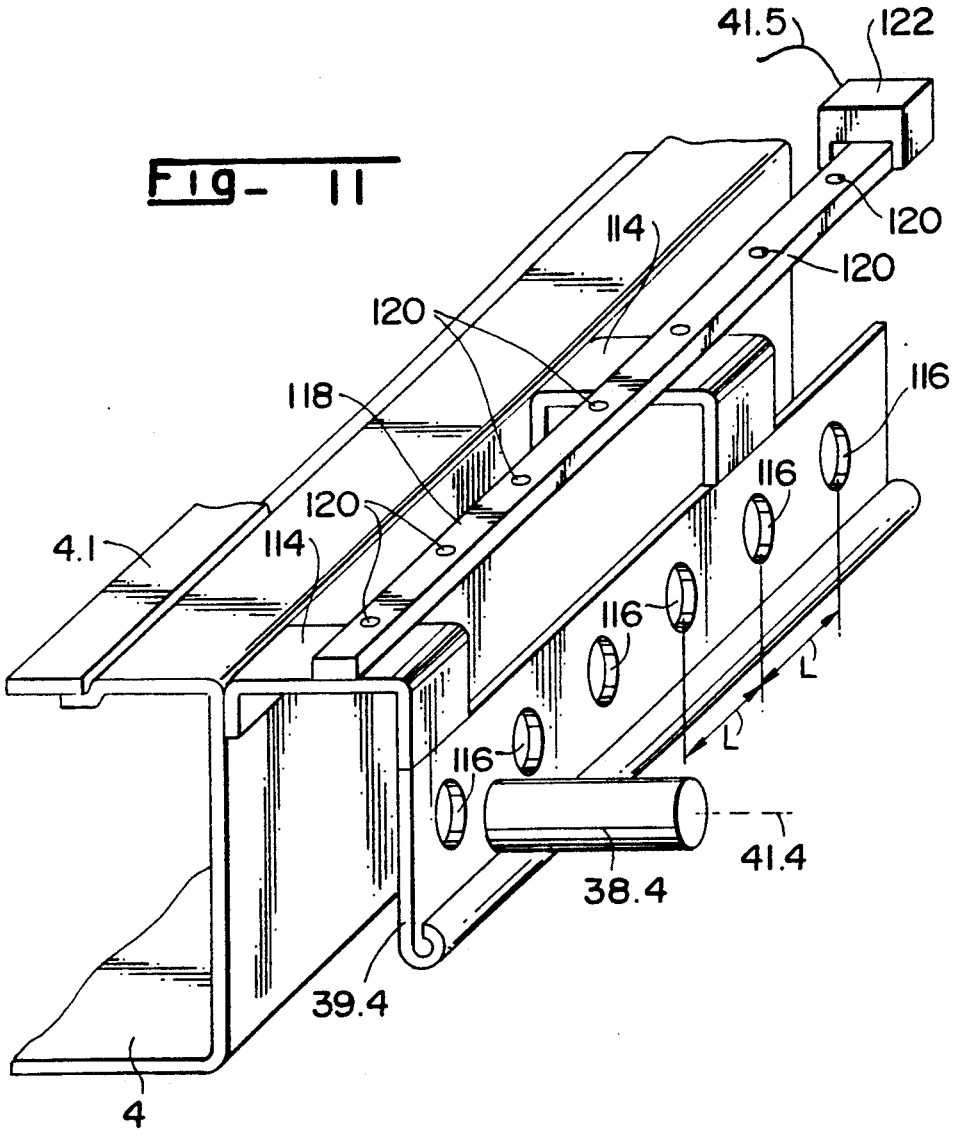
FIG. 11 is a perspective illustration of an embodiment of an apertured rail in a slip-free length measuring device modified relative to FIG. 1, with the use of mechanical switches for the slip-free length measurement also being shown.

FIG. 11 shows a further embodiment in which an apertured rail 39.4 is secured via brackets 114 to the flock transport duct 4. Circular holes 116 are arranged in the apertured rail 39.4 at a constant spacing L. As the flock transport duct is very long, only the start of this duct is shown in FIG. 11. This figure also indicates a displaceable cover 4.1 of the flock transport duct which, in a known manner, ensures that the flock transport duct, which operates in suction, is closed other than at the position at which the tower feeds the opened fiber flocks into the duct. For the sensing of the row of holes 116, an inductive proximity switch 38.4 is provided in the embodiment of FIG. 11 and is secured to the machine frame of the bale opening machine and thus moves with the tower of the bale opening machine along the apertured rail 39.4, i.e., along the bale row. Each time the inductive proximity switch passes one of the holes 116, it generates a pulse and its pulse sequence is applied via the line 41.4 to the microprocessor 22 in correspondence with the other embodiments.

The FIG. 11 also shows an alternative embodiment in which a bar 118 with recesses 120 which have a regular, i.e., constant spacing from one another, is likewise secured to the brackets 114. Above the bar, which is of rectangular cross-section, there is located a mechanical sensor 122 which is secured to the machine frame 3 of the tower of the bale opening machine and thus moves with the tower along the bar 114 and along the bale row. The mechanical sensor 122 has a stylus with a hemispherical end (not shown) which, on passing the recesses 120, is pressed each time by spring tension into the respective recess and, as a result of the relative movement and the hemispherical surface, is then pushed out again. Each time the stylus moves into a recess, a mechanical switching procedure is triggered, which moves the electrical switching contacts, and a corresponding pulse sequence is applied to the microprocessor 22 via the line 41.5.

Figure 12:
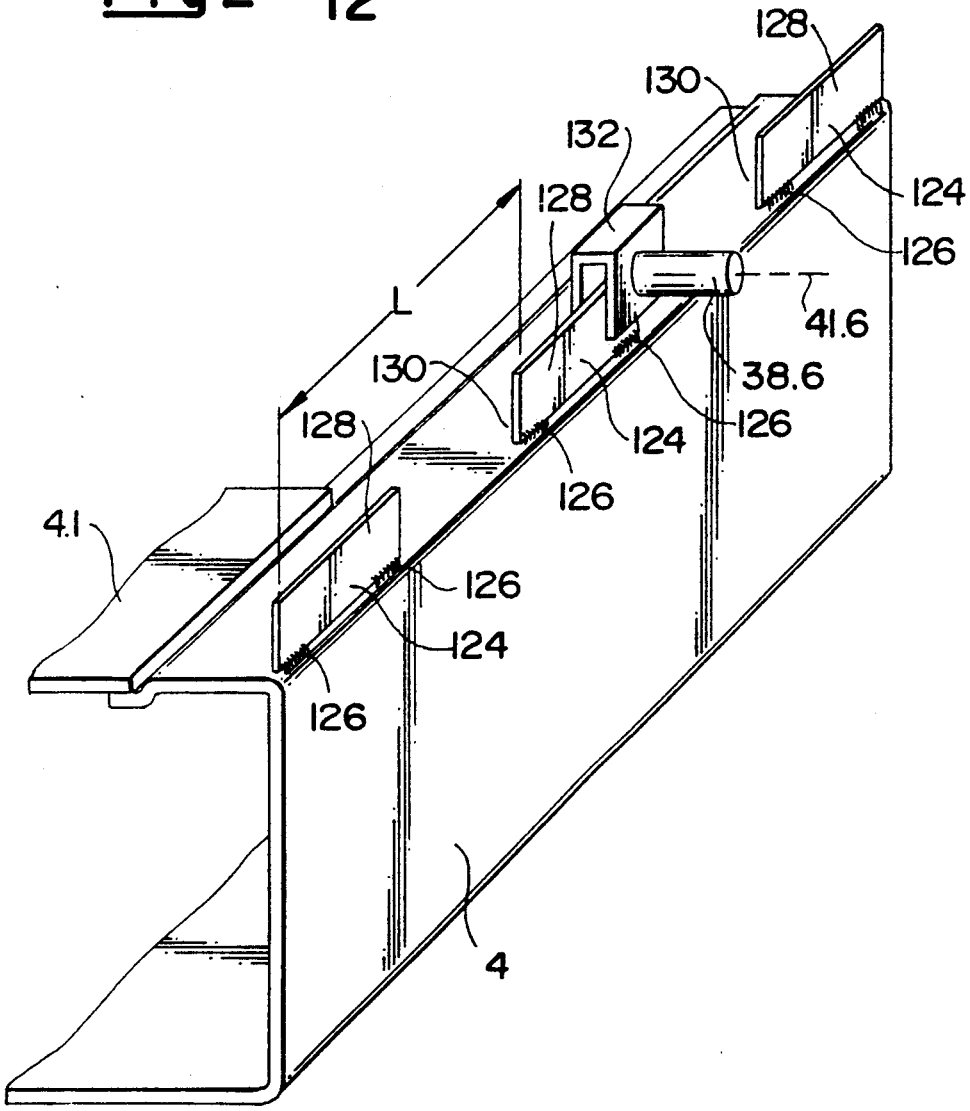
FIG. 12 is a further slip-free length measuring device in accordance with the invention having an elongate measuring structure consisting of gaps and teeth.

Finally, FIG. 12 shows an even simpler arrangement in which rectangular sheet metal parts 124 are welded at 126 in regular intervals to the flock transport duct 4 so that the sheet metal parts form teeth 128 having gaps 130 located therebetween. Although the teeth and gaps have the same width in FIG. 12, this is not necessary. A sensing device 38.6 formed as a light barrier is secured via a C-shaped mount 132 to the machine frame 3 of the tower (not shown in FIG. 12), with the light barrier, here comprising transmitting and receiving parts. The beam which extends between these two parts is periodically interrupted and then freed again by the vertical edges of the teeth 128 as a result of the relative movement. This generates a pulse sequence which is transmitted, as previously mentioned, to the microprocessor 22 via the line 41.6.

In all of the foregoing embodiments, the computer is able to determine the direction in which the tower moves, for example, as a result of the drive signals applied to the drive motor. Thus, the microprocessor is able to determine the longitudinal position of the tower along the bale opening machine, i.e., along the bale row, depending upon the direction of movement of the tower, by summing or subtracting the transmitted pulses. It can also be advantageous to provide a special marking at the start and at the end of the bale row so that these positions can be identified by the computer in an unequivocal manner. Such markings can, for example, be formed by a special formation of the row of holes or of the row of teeth themselves. For example, two adjacent holes at the two ends of the elongate rail could be combined to form an elongate slot, with the output signal of the corresponding sensing means lying at a constant level and no longer being switched on and off, as occurs during a movement along the bale row.

As previously mentioned, the structure formed by the row of teeth or row of holes can have a very coarse raster with the longitudinal measurement in the region between the individual markings taking place by interpolation. This process is schematically shown in FIG. 5. The box 140 represents an interpolating means which subdivides the time intervals between sequential pulses, as a result of the signals read in via the lines 41, 41.1, 41.2, 41.3, 41.4, 41.5 or 41.6 and, as a result of the information present in the computer concerning the speed or acceleration or retardation of the movement of the tower along the row of bales, so that the corresponding time signals also serve as a measure for the longitudinal position of the tower along the row of bales, so that the corresponding time signals also serve as a measure of the longitudinal position of the tower along the row of bales. If the speed of movement is constant, then the time intervals should be subdivided into constant units.

If, for example, the speed of movement amounts to 1 m/sec and the holes of the rail have a distance from one another of 20 cm, then signals occur via the line 41 with a time interval between the individual pulses of 0.2 sec. At constant speed, a time unit of 0.01 sec thus corresponds to 0.01 m (equals 1 cm). Thus, sensor measurements can, for example, be carried out after every centimeter of advance when the interpolating means, after each pulse from the line 41-41.6, transmits reading pulses to the measuring sensor 30 via the counting device 144 and the line 33 in time intervals of 0.1 sec.

Furthermore, the computer 22 can include a monitoring means 142 which checks that on the occurrence of the next pulse via the line 41-41.6, the longitudinal position computed by the interpolating means corresponds with the position which is marked in trouble-free manner by these pulses. Should this not be correct, then the longitudinal positions computed between the two last pulses from the line 41-41.6 must be considered to be incorrect and should thus be ignored. The box 144 shows the counting device which counts the pulses via the line 41-41.6 and/or from the interpolating means 140 and hereby generates a signal proportional to the distance of travel. The interpolating means 140, the monitoring means 142 and the counting means 144 are integrated here into the computer 22, i.e., realized in software. They can also represent separate units, i.e., be realized as hardware.

Finally, although the invention has been described with reference of particular means, materials and embodiments, it is to be understood that the invention is not limited to the particulars disclosed and extends to all equivalents within the scope of the claims.

What is claimed is:

1. A distance of travel measuring device for use with a bale opening apparatus, the bale opening apparatus including a non-slipfree drive system and a travelling tower which is movable by means of the drive system along a bale row, said measuring device comprising:

an elongated part adapted to extend along the bale row;

means for sensing said elongated part in a slipfree manner during movement of said bale opening machine along the bale row;

means for transmitting a pulse signal at the occurrence of a predetermined increment of movement of said tower along said bale row; and means for counting said pulse signals and generating a signal representative of distance travelled by said tower along said bale row.

2. The distance of travel measuring device of claim 1, said elongated part being a rail, said means for sensing being a wheel mounted on said tower for slip-free rolling along said rail, and said means for transmitting a pulse signal being operatively connected with said wheel for transmitting said pulse signal.

3. The distance of travel measuring device of claim 2, said rail being a rack and said wheel being a gearwheel which meshes with said rack.

4. The distance of travel measuring device of claim 1, said elongated part being a chain fixedly mounted relative to said tower, chain deflecting devices adapted to be located at opposite ends of the bale row for guiding endless movement of said chain as said tower moves along the bale row, said means for sensing being a chain sprocket driven by said chain, and said means for transmitting a pulse signal being operatively connected with said chain sprocket for transmitting said pulse signal.

5. The distance of travel measuring device of claim 4, said chain sprocket forming one of said chain deflecting devices.

6. The distance of travel measuring device of claim 1, said elongated part having a repeating pattern of discontinuities, said means for sensing being capable of sensing said discontinuities.

7. The distance of travel measuring device of claim 6, said elongated part being a rail, said repeating pattern of discontinuities being formed by apertures in said rail.

8. The distance of travel measuring device of claim 6, said repeating pattern of discontinuities being formed by teeth and gaps between said teeth.

9. The distance of travel measuring device of claim 6, said elongated part being a fixedly tensioned chain, said repeating pattern of discontinuities being formed by links in said chain.

10. The distance of travel measuring device of claim 6, said means for sensing being a light sensor.

11. The distance of travel measuring device of claim 6, said means for sensing being an inductive sensor.

12. The distance of travel measuring device of claim 6, said discontinuities being spaced apart by more than approximately ten centimeters, and said distance of travel measuring device further comprising an interpolating means for measuring distance travelled by said tower.

13. The distance of travel measuring device of claim 12, further comprising means for monitoring time intervals between said pulse signals.

14. The distance of travel measuring device of claim 13, said counting means, interpolating means, and said monitoring means being integrated in a microprocessor.

* * * * *

UNITED STATES PATENT AND TRADEMARK OFFICE

CERTIFICATE OF CORRECTION

PATENT NO. : 5,121,418

DATED : June 9, 1992

INVENTOR(S) : C. STAHELI et al.

It is certified that error appears in the above-indentified patent and that said Letters Patent is hereby corrected as shown below:

On the title page, item [30], under "Foreign Application Priority Data", change "[CH] Switzerland" (both occurrences) to --[DE] Germany--.

Signed and Sealed this

Twenty-fifth Day of October, 1994

*Attest:*

Bruce Lehman

BRUCE LEHMAN

*Attesting Officer*

*Commissioner of Patents and Trademarks*